US006988727B2

(12) United States Patent
Yano

(10) Patent No.: US 6,988,727 B2
(45) Date of Patent: Jan. 24, 2006

(54) SHEET CONVEYANCE APPARATUS, IMAGE FORMING APPARATUS, AND METHOD FOR ESTIMATING DURATION OF A ROTARY MEMBER

(75) Inventor: Takashi Yano, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 10/383,629

(22) Filed: Mar. 10, 2003

(65) Prior Publication Data

US 2003/0173736 A1 Sep. 18, 2003

(30) Foreign Application Priority Data

Mar. 12, 2002 (JP) ..... 2002-066440

(51) Int. Cl.
*B65H 5/00* (2006.01)
*G08B 21/00* (2006.01)
*G08B 29/00* (2006.01)

(52) U.S. Cl. ..... 271/264; 340/674

(58) Field of Classification Search ..... 271/264, 271/3.15, 3.17, 4.02, 4.03, 10.02, 10.03; 271/340/673, 674, 686.3
See application file for complete search history.

(56) References Cited

U.S. PATENT DOCUMENTS 4,398,711 A * 8/1983 Horst et al. ..... 271/263
5,342,037 A * 8/1994 Martin ..... 271/111
5,678,159 A * 10/1997 Williams et al. ..... 399/395
6,282,403 B1 * 8/2001 Spencer et al. ..... 399/406
6,578,842 B2 * 6/2003 Hoberock ..... 271/117
6,761,351 B1 * 7/2004 Howe ..... 271/3.15

* cited by examiner

*Primary Examiner*—Donald P. Walsh
*Assistant Examiner*—Mark J. Beauchaine
(74) *Attorney, Agent, or Firm*—Fitzpatrick, Cella, Harper & Scinto

(57) ABSTRACT

The present invention relates to a sheet conveyance apparatus comprising a rotary member for conveying a sheet; a controller for detecting lowered conveyance performance due to wear of the rotary member, for measuring operation time of the rotary member, for memorizing in advance a limit wearing degree immediately before the rotary member becomes unable to make conveyance due to wear, and for estimating a time at which the rotary member becomes unable to make conveyance due to wear. The duration estimating means uses the wearing degree of the rotary member, the operation time of the rotary member, and the limit wearing degree, to calculate according to an estimation function the time ending the duration at which the rotary member becomes unable to make conveyance due to wear.

15 Claims, 7 Drawing Sheets

SHEET CONVEYANCE APPARATUS, IMAGE FORMING APPARATUS, AND METHOD FOR ESTIMATING DURATION OF A ROTARY MEMBER

BACKGROUND OF THE INVENTION

1. Field of the Invention

This invention relates to a sheet conveyance apparatus for conveying sheets in use of a rotary member, an image forming apparatus having the sheet conveyance apparatus, and a rotary member lifetime estimation method for estimating duration of the rotary member.

2. Description of Prior Art

In image forming apparatuses for forming images on sheets, a roller made of a rubber material is widely used as a rotary member for conveying sheets with a sheet conveying means such as a sheet feeding section or sheet conveying section for conveying sheets. The roller made of the rubber material, however, shows a wearing phenomenon such as reduction of the roller radius from the property or reduction of the frictional coefficient to the sheet, due to wear of the surface as conveying sheets more. When the roller is worn further, the conveyance efficient of the roller is lowered gradually, and then, it becomes difficult to supply the sheets with a predetermined interval to the image forming area, thereby generating jamming due to delay.

If the roller is continuously used without replacing the roller until a circumstance that the jamming due to delay likely occurs, the user is finally forced to operate the image forming apparatus not properly, and therefore, a system is needed in which necessity of the replacement is detected in advance and the serviceman can come to care the roller. To conventionally realize this, mainly used were two methods: a method in which a counter for counting the number of sheets passing is utilized, and a method in which a conveying timing for sheets is used.

In the former, an estimated total conveyable distance of the sheets until when the roller reaches the end of the lifetime is stored in a memory on a controller, and a signal is outputted for informing nearness of the roller's duration at a stage a little before the accumulated conveyance distance of the roller calculated from the passing sheet number information counted with the counter and from the size information of the actually passing sheets, reaches the total conveyable distance registered in the memory on the controller.

In a meantime, the latter is a system in which the passing timing of the sheets is always monitored with a sheet detection sensor formed on a sheet conveyance route, and if the timing is delayed more than a certain amount according to wear on the roller, it is judged as that the duration of the roller comes closer to the end, and a warning signal is outputted.

In those duration detecting methods, theoretically, any trouble due to wear on the roller can be prevented, and the roller can be replaced before such a trouble occurs.

With those duration detecting methods, however, although the system can inform that "it is close to the end of the roller's duration based on the accumulated conveyance distance" or can detect the fact that "the conveyance efficiency on the roller is lowered to the predetermined value," the system cannot estimate "when the roller reaches the end of the duration." This is because it is impossible to guarantee a fixed total conveyable distance for rollers in all products, and the period reaching the end of the duration cannot be constant, since the wearing degree on the roller depends on various factors such as installation circumstances around the apparatus at a place of the use, types of the used sheets, use frequency of the apparatus, etc. Therefore, the conventional duration detecting methods could not correspond flexibly to the use circumstance of the apparatus, and also, it was difficult to judge which user has to receive the maintenance work with priority, so that the services tend to loose efficiency, and so that some problem was raised in which the replacement was not in time.

SUMMARY OF THE INVENTION

To solve the above problems, developments in duration estimating methods for accurately estimating roller's lifetime are sought.

A representative structure of the invention to solve the above problems is having a sheet conveyance apparatus including: a rotary member for conveying a sheet, a wearing degree detecting means for detecting lowered conveyance performance due to wear of the rotary member, a time managing means for measuring operation time of the rotary member, a limit wearing degree memorizing means for memorizing in advance a limit wearing degree immediately before the rotary member becomes unable to make conveyance due to wear, and a duration estimating means for estimating a time at which the rotary member becomes unable to make conveyance due to wear; wherein the duration estimating means uses the wearing degree of the rotary member detected by the wearing degree detecting means, the operation time of the rotary member measured by the time managing means, and the limit wearing degree memorized by the limit wearing degree memorizing means, to calculate according to an estimation function the time ending the duration at which the rotary member becomes unable to make conveyance due to wear.

DETAILED DESCRIPTION OF THE PREFERRED EMBODIMENTS

Figure 1:
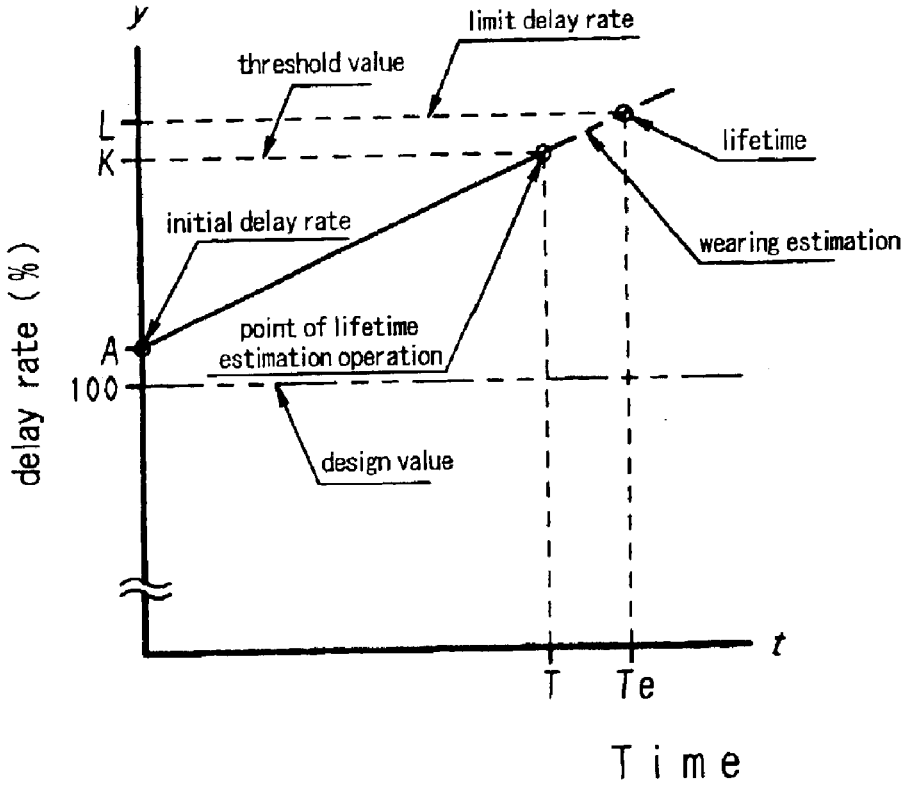
FIG. 1 is an illustration showing an duration estimating algorithm in a first embodiment.

Hereinafter, referring to the drawings, preferred embodiments of the invention are described in detail in an exemplifying manner. The size, material, shape, and arrangement of the structural parts described in the embodiments below can be modified properly according to the apparatus structure to which the invention applies or to various conditions, and as far as no specific description is given, the scope of this invention should not be limited to those description.

The First Embodiment

Figure 2:
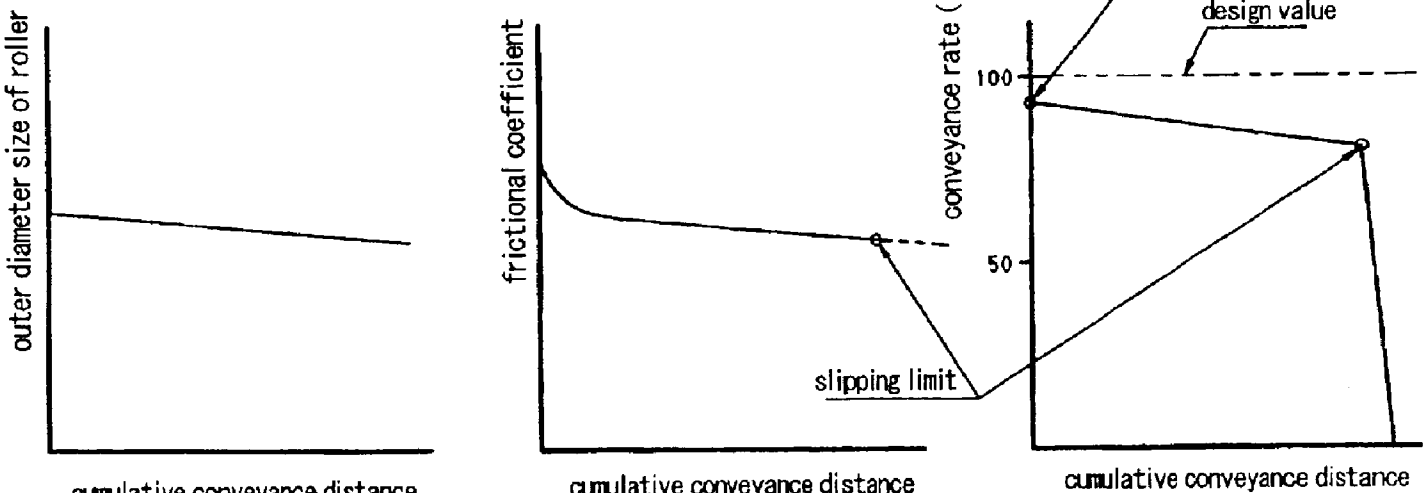
FIG. 2 is an illustration showing a transition of the roller outer diameter, the frictional coefficient, the conveyance efficiency according to wear of the roller.
Figure 3:
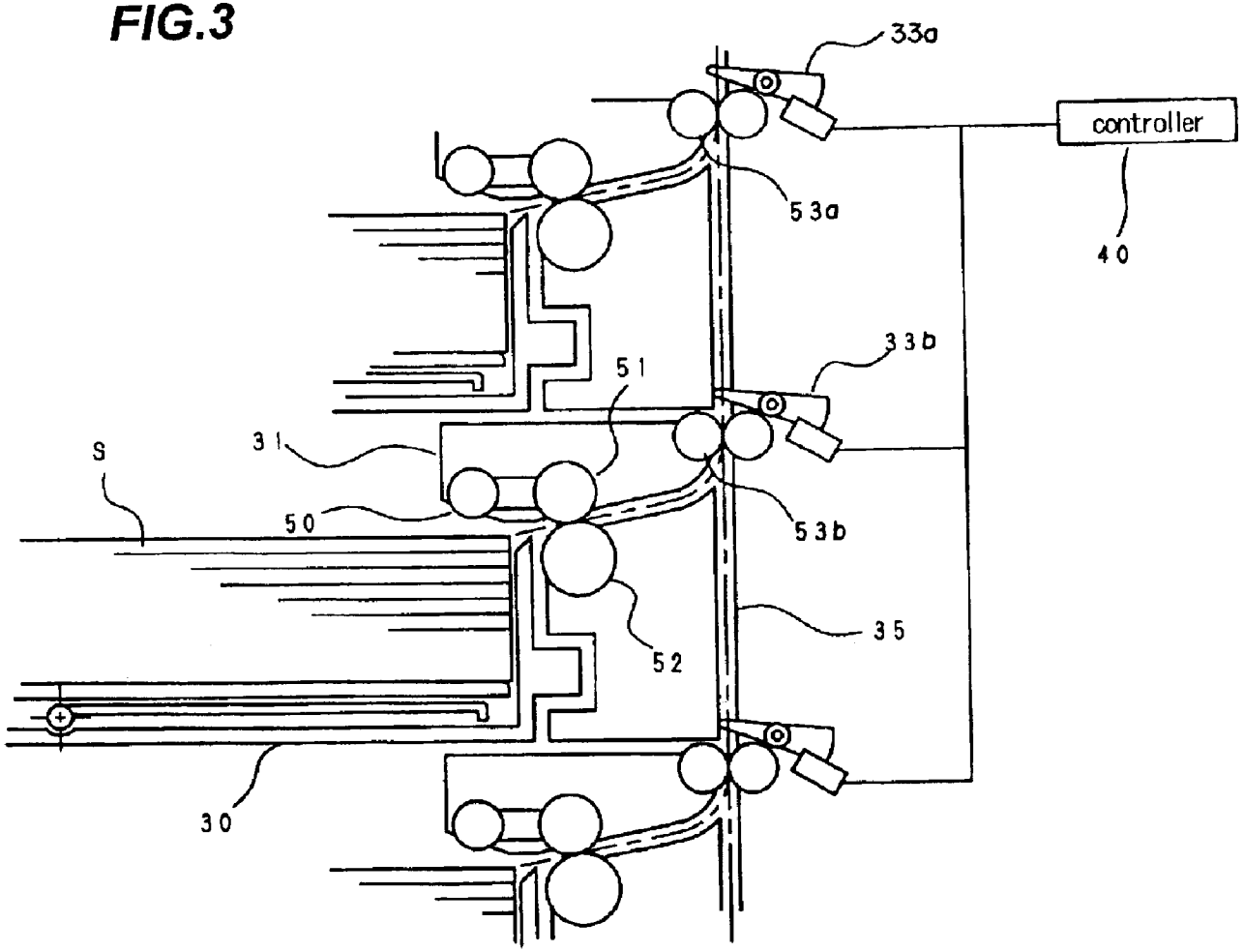
FIG. 3 is a schematic cross section showing a sheet feeding section of an image forming apparatus.
Figure 4:
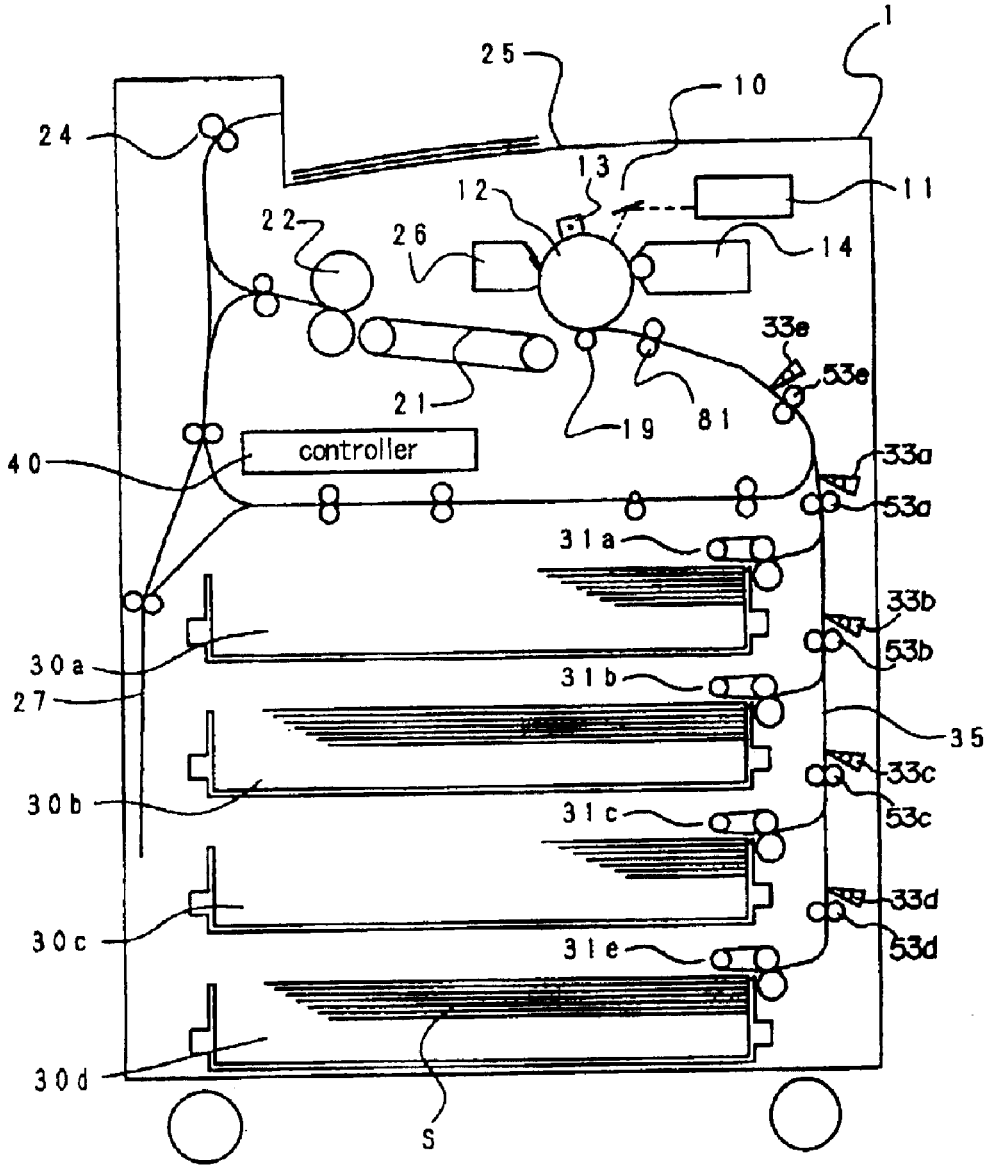
FIG. 4 is a schematic cross section of the image forming apparatus.

Referring to FIG. 1 to FIG. 4, the embodiment of the invention is described. FIG. 4 is a cross section of a printer serving as an image forming apparatus formed with a duration estimating means to which this invention applies. The numeral 1 is a printer body, and a laser scanner 11 is provided at a top of the printer body 1 for writing images on a photosensitive drum 12. Printing data transmitted from an external information terminal such as a personal computer are received at a controller 40 serving as a controlling means for controlling the printer body 1 and outputted to the laser scanner 11 as the writing image data.

A sheet feeding section is located at the most upstream position of the sheet conveyance, and this printer of the embodiment includes four stages in total at a lower portion of the apparatus. The sheet feeding section is constituted of feeding cassettes 30 (30*a* to 30*d*) for stacking and containing the sheets, and feeding units 31 (31*a* to 31*d*) for separately feeding the sheets S contained in the feeding cassettes. As shown in FIG. 3, arranged in the feeding unit 31 are a pickup roller 50 for picking up the sheets S in the feeding cassettes 30, a feeding roller 51 for feeding the sheets picked up by the pickup roller 50, a separation roller 52 facing to the feeding roller 51 for separating a sheet by application of separation force in a reverse direction of the sheet, and conveyance rollers 53 (53*a* to 53*e*) for successively conveying the sheet fed by the feeding roller 51 and pulling out the sheet from a nipping portion between the feeding roller 51 and the separation roller 52 after the feeding roller 51 stops driving to convey the sheet. Sheet detection sensors 33 (33*a* to 33*e*) are formed at a position immediately after the respective conveyance rollers 53 (53*a* to 53*e*). The respective conveyance rollers 53, in addition to operate the pulling action of the sheet as described above, play a role to succeed the conveyance of the sheets conveyed through the vertical conveyance path 35 from the sheet feeding section located on an upstream side in the sheet conveyance direction.

A registration roller pair 81 as shown in FIG. 4 is arranged at the most downstream position of the vertical conveyance path 35, and performs correction to obliquely feeding of the sheets at the final and matching timings of the image writing at the image forming section and the sheet conveyance.

The image forming section includes a photosensitive drum 12, a charger 13 for making electrical charges uniformly on the surface of the photosensitive drum 12, a developing unit 14 for developing, to toner images to be transferred to the sheet S, an electrostatic latent image formed on the surface of the photosensitive drum 12 charged by the charger 13 by depicting light images with the laser scanner 11, a transfer roller 19 for transferring to the sheet S toner images developed on the surface of the photosensitive drum 12, and a cleaner 26 for removing toner remaining on the photosensitive drum 12 after the toner image is transferred.

A sheet conveyance section 21 for conveying the sheet S to which the toner image is transferred, and a fixing unit 22 for fixing, as permanent images, the toner images on the sheet S conveyed by the sheet conveyance section 21 are provided on a downstream side of the image forming section. A delivery roller 24 is arranged for delivering, out of the printer body 11, the sheet S on which the images are fixed at the fixing unit 22. A delivery stacking tray 25 is formed on a top outer side of the printer body 1 for receiving the sheet S delivered by the delivery roller 24.

Now, a structure of the duration estimating means for estimating a time at which the rotary member becomes unable to make conveyance due to wear of the rotary member conveying the sheets is described. First of all, a mechanism of the duration of the roller as a rotary member for conveying the sheets is described. In a case of ordinary rubber rollers, the outer diameter size of the roller and the frictional coefficient of the roller surface transit as in graphs shown in FIGS. 2(*a*), 2(*b*), according to the sheet's passage. Because the conveyance distance per one turn becomes shorter where the outer diameter of the roller is worn, and because the slipping rate increases as the surface frictional coefficient is lowered, the sheet conveyance rate in which the designed value is set as 100% is gradually lowered as a graph in FIG. 2(*c*). Then, jamming due to delay may occur when the conveyance rate is reduced, e.g., when the sheet feeding becomes behind the time for image forming operation at the image forming section. In a case where a cause to become a conveyance load against sheets in the conveyance route exists, there is a slipping limit as shown in FIGS. 2(*b*), 2(*c*) in relation with the lowered friction coefficient, and if the operation reaches the limit, the roller slips completely and fails to conveyance the sheets, thereby generating jamming due to delay. The state in which the printer body cannot control at predetermined timings due to the above conditions is called as the duration of the roller.

Figure 7:
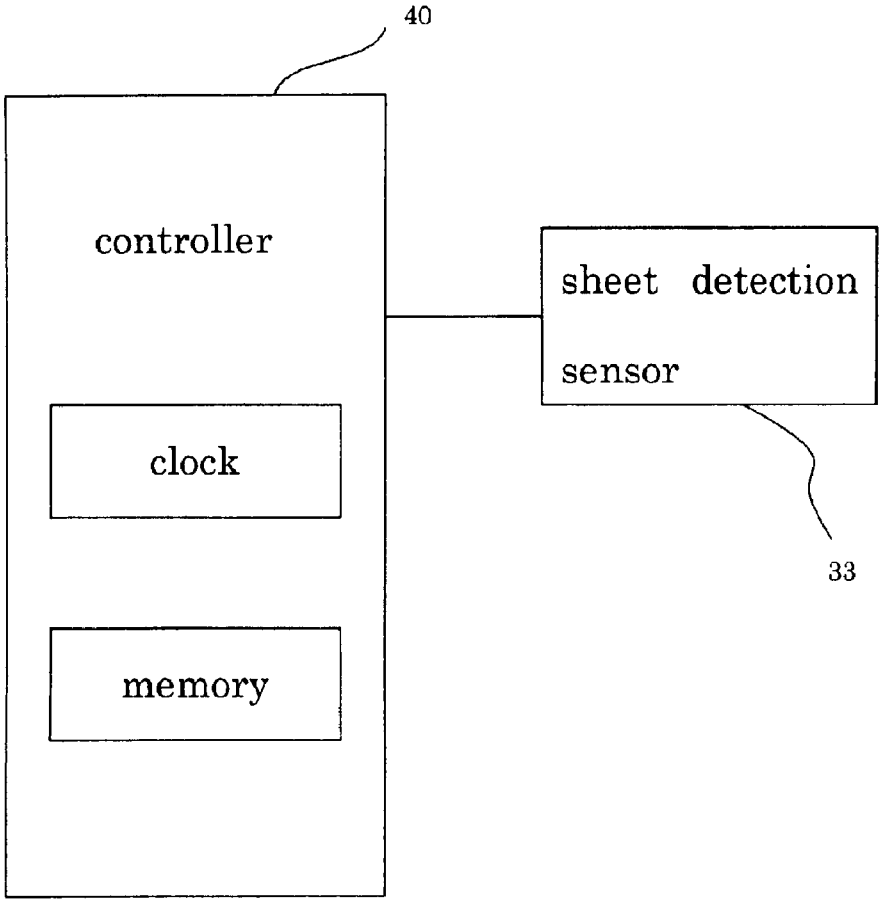
FIG. 7 is an block diagram showing a controller.

Referring to FIG. 7, It is necessary to mount a wearing degree detecting means for worn state of the roller to detect the closeness to the duration before the roller reaches the end of the duration. In this embodiment, a sheet detection sensor 33 and a controller 40 as the wearing degree detecting means are used and monitor timing that the fed sheet reaches the sheet detection sensor 33. The delay rate of the timing with respect to the designed value is an evaluation value representing the wearing degree of the roller. The sheet detection sensor 33 is also used as a sheet position detecting means when the controller 40 controls the printer body 1, and a detecting means for detecting remaining locations of the jammed sheets. In this embodiment, as shown in FIG. 3, the wearing degree of the feeding roller 51 as a rotary member is detected from time at which the sheet reaches the first sheet detection sensor 33*b* after the feeding operation begins, and the wearing degree of the feeding roller 53*b* as a rotary member is detected from time at which the sheet reaches the subsequent sheet detection sensor 33*a* after the sheet reaches the sheet detection sensor 33*b*.

Next, an estimating method of the duration period of the roller using the duration estimating means is described. In the printer of this embodiment, a threshold value (standard wearing degree) K of the delay rate y of the sheet conveyance timing is set respectively for each type of the rollers, and is memorized in advance in a memory installed in the controller 40 as the memorizing means. The threshold value K is set with a prescribed margin with respect to the limit delay rate L immediately before the roller reaches the end of the duration. The controller 40 functioning as the duration estimating means as well as a controlling means of the apparatus performs duration estimating operation with an estimation function as described below at a time when the actual wearing degree of the roller monitored by the sheet detecting sensor 33 and the controller 40 as the wearing degree detecting means, or namely the delay rate reaches the threshold value K, thereby estimating the duration period of the corresponding roller.

For operation of the duration estimation done by the controller 40, used is the wearing degree of the corresponding roller, or namely the delay rate y to the prescribed value of the timing that the sheet reaches the sheet detection sensor 33 in relation to the roller. Information of passed time t since the roller was replaced last time, for example, the operation time from the initial state of the roller to the present time, is used. It is to be noted that the operation time t of the roller is measured in utilizing a clock function as a time managing means installed in the controller 40 in the printer body. The limit delay rate L immediately before the roller reaches the end of the duration is memorized in advance in a memory on the controller 40 as a limit wearing degree memorizing means.

With the embodiment, the controller 40 calculates the duration period at which the roller becomes unable to make conveyance based on a proportional function (linear function) as an estimation function shown in FIG. 1 in utilizing the delay rate (wearing degree) of the roller detected by the sheet detection sensor 33 and the controller 40, the operation time of the roller measured by the clock function in the controller 40, and the limit delay rate (limit wearing degree) memorized in the memory in the controller 40.

That is, in the estimation operation formula (duration operating algorithm) used in this embodiment, the duration period Te of the roller is expressed with the following Formula (1-2) (see, FIG. 1), $$Te=T\times(L-A)/(K-A) \tag{1-2}$$

wherein: the delay rate of the sheet conveyance timing of the corresponding roller during the operation executing period is denoted as K% (namely, it is the threshold value where the ideal designed value is 100%. K>100); the delay rate of the roller at the initial state of the roller is denoted as A%; the limit delay rate at the state immediately before the end of the duration of the roller is denoted as L%; a passed time from the roller's replacement (the initial state of the roller) is denoted as T. It is to be noted that if the following Formula (1-1) is solved with an equation y=L where a variant of time is t (X-axis) and where a variant of the delay rate is y, the duration period Te is sought as time t at L.

$$y=(K-A)/T\times t+A \tag{1-1}$$

This utilizes that delay rate transition of the sheet conveyance timing can be approximated with a linear function. In this embodiment, for example, K=125, A=110, and L=130 is set for calculation of the duration period of the feeding roller 51 as a rotary member; K=115, A=103, and L=120 is set for calculation of the duration period of the feeding roller 53 as a rotary member; those are memorized in the memory on the controller 40 as the memorizing means. These values are required to be set properly according to targeted locations at which the lifetime is estimated because those may vary according to such as the mechanism or controlling method of the sheet feeding section or rubber material property of the roller.

If the duration estimating operation is made as the delay rate of the sheet by the roller conveyance exceeds the threshold valve, the controller 40 also serving as information communicating means automatically transmits the operation result to a service center through a network line. With this transmission, servicemen at the service center can understand by when they should come to replace the roller or rollers.

As described above, according to the embodiment, the duration period of the roller that may vary according to circumstances of the installation of the printer body, kinds and use frequency of the sheets used by the users, and the like can be estimated with flexibility and great accuracy. Consequently, troubles such as jamming due to delay can be surely prevented from occurring.

Because the service station side can monitor with good accuracy the replacement timing of the rollers installed in the user's apparatus by transmission of the duration period information to the service station or center through the network, the service station side can optimize as to which roller replacement has a priority. Consequently, no jamming occurs due to delay of replacements, and therefore the quality of the service can be promoted significantly while the efficiency of the services can be improved greatly.

Moreover, running costs can be advantageously reduced not because the rollers having plenty time before the duration period are replaced in an early timing but because rollers can be replaced after used adequately.

The Second Embodiment

In the first embodiment, duration estimation of the roller is made in use of the duration operating algorithm in which the transition of the roller's delay rate is approximated with the linear function as an estimation function for calculating the duration period of the roller, but this invention is not limited to the above. In a printer having the same structure as in the first embodiment, it is difficult to approximate a phenomenon with a proportional function (linear function) as in the first embodiment where, e.g., the roller has property that worn slightly at the initial stage but greatly, abruptly as closer to the end of the duration. As a structure to overcome this difficulty, in the second embodiment, the phenomenon is approximated with an estimation curve composed of a linear function and a quadratic function (see, FIG. 5 and FIG. 6) as an estimation function. It is to be noted that although a part of the linear function of the estimation curve is usable for duration estimation, the first embodiment is applicable to that method, and therefore, a method for estimating the duration period of the roller from the part of the quadratic function (duration operating algorithm) is described hereinafter.

It is very difficult to estimate the duration period, in comparison with the proportional property of the first embodiment, in regarding a roller having property worn slowly at the initial state but acceralatingly when coming closer to the end of the duration. This is because the estimation tends to be deviated from the actual consequence due to factors such as individual differences among rollers or external disturbances. In the second embodiment, the estimation curve is determined from a processing of two stages to provide the final duration estimation of the roller.

The steps of the duration estimation for this roller include the two stages in which: first, based on a known standard curve, a preliminary estimation curve is determined as a basis, and second, to improve the accuracy, a final estimation curve is produced in modifying the preliminary estimation curve as matching to the actual phenomenon, thereby executing the duration estimation operation according to the function.

Figure 5:
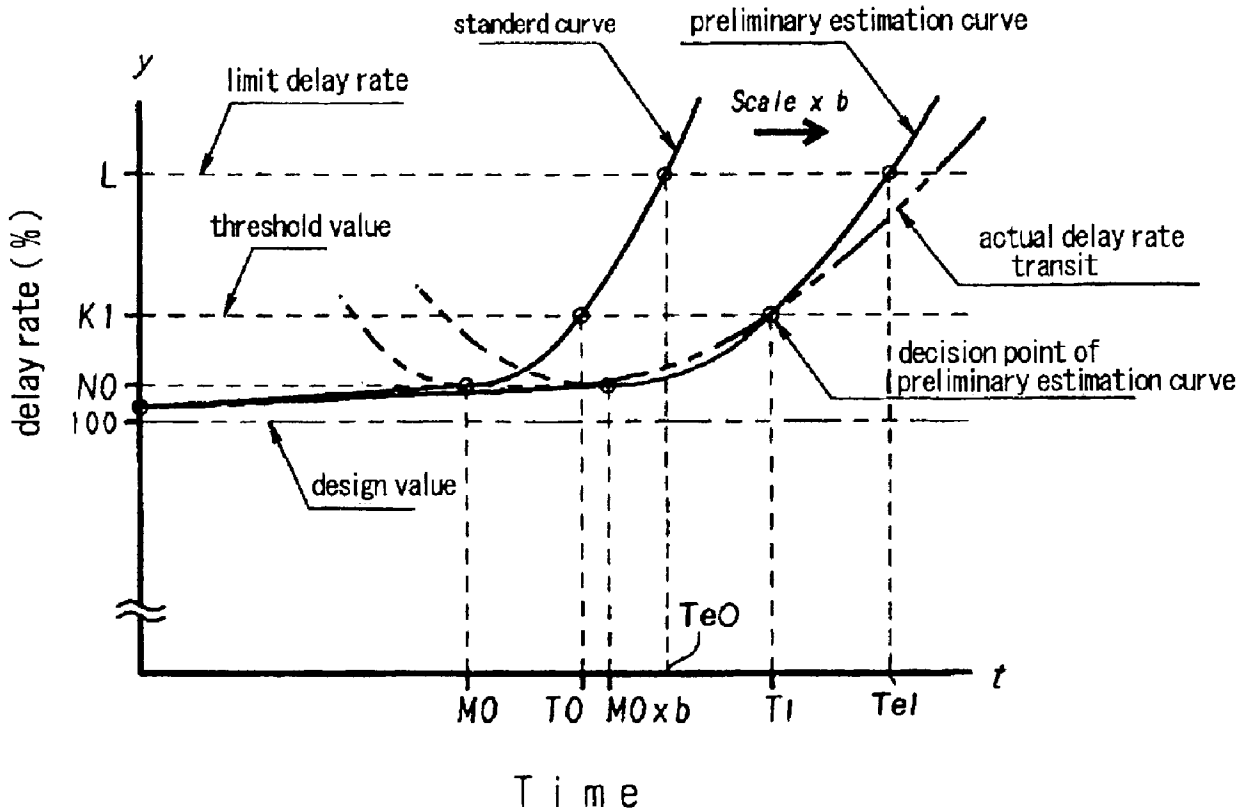
FIG. 5 is an illustration showing a duration estimating algorithm in the second embodiment.
Figure 6:
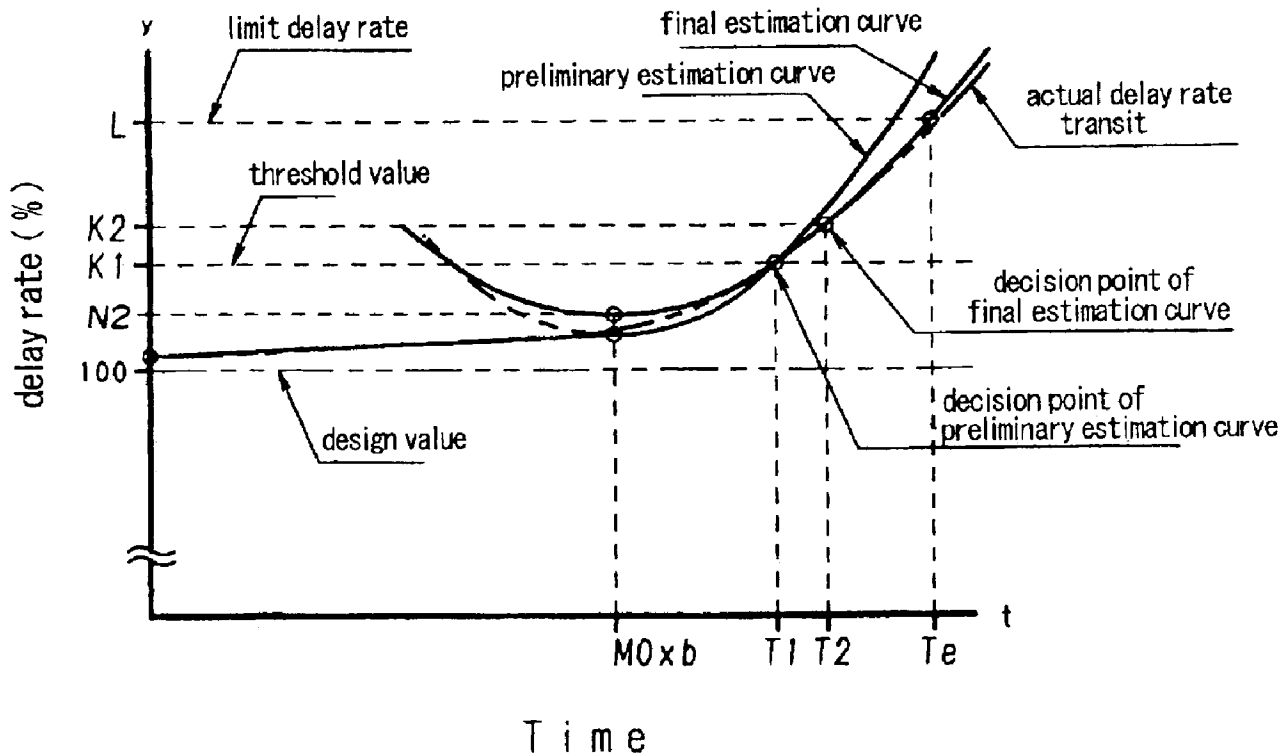
FIG. 6 is an illustration showing a duration estimating algorithm in the second embodiment.

The above first process is made when the timing delay rate of the sheet conveyance exceeds the preset threshold value, and the above second process is made upon confirming the timing delay rate again after a certain preset period is passed. Referring to FIG. 5 and FIG. 6, the detailed contents of the processes are described hereinafter.

The estimation curve (hereinafter, referred to as "estimation curve" about the portion of the quadratic function) is defined with the following Formula (2) wherein the timing delay rate is denoted as y; the operation time is denoted as t; the apex coordinate of the quadratic function is denoted as (M, N). It is to be noted that, in Formula (2), B indicates the coefficient of the gradient of the quadratic function; M indicates the X coordinate (time axis) of the apex of the quadratic function; N indicates the Y coordinate (delay rate axis) of the apex of the quadratic function.

$$y=B\times(t-M)^2+N \tag{2}$$

The parameters B, M are values that may vary according to the use circumstances of the printer body. If the use frequency is high, the curve shape is contracted in a time axis direction with reference of t=0, and conversely, if the use frequency is low, the shape is extended in the same direction. That is, if one delay rate transition curve at a certain use frequency is known in advance, the estimation curve can be produced even for situations with different use circumstances. In this embodiment, the delay rate transition curve in a situation that the feeding operation is done with a pace of 10,000 sheets per day is sampled in advance, and the estimation curve as a standard (hereinafter referred to as "standard curve") is defined. The function expressing the standard curve (see, FIG. 5) at that time is represented as the following Formula (3).

$$y=B0\times(t-M0)^2+N0 \tag{3}$$

With the standard curve, a period at which the delay rate y reaches the threshold value K1 to trigger the execution of the roller's duration estimation is defined as T0 (already known). It is to be noted that the standard curve shown in FIG. 5 is an approximated curve obtained from the data of the delay rate transition that already has been researched in advance, and the parameter values (specific values of B, M, N) are memorized in advance in the memory on the controller 40 serving as a memorizing means.

The first process is described based on the standard curve. The determining process of the preliminary estimation curve shown in FIG. 5 is performed at a time when the actual wearing degree of the roller, or namely delay rate y, which is monitored with the sheet detection sensor 33 serving as a wearing degree detecting means and the controller 40, reaches the threshold value K1 where the feeding roller is used. Because the real operation time T1 can be measured from the last replacement of the roller to the present time by the clock function mounted in the controller 40 as a time managing means, the magnification difference b in the time axis direction between the standard curve and the present delay transition curve is sought by following Formula (4). With this calculation, the parameters B, M of the present estimation curve are determined by following Formulae (5), (6), and the function of the preliminary estimation curve (Formula 7) shown in FIG. 5 is completed where the timing delay rate is y; the operation time is t; the apex coordinates of the quadratic function are (M0×b, N0).

$$b=T1\times T0 \tag{4}$$

$$B=B0/b^2 \tag{5}$$

$$M=M0\times b \tag{6}$$

$$y=(B0/b^2)\times(t-M0\times b)^2+N0 \tag{7}$$

It is to be noted that where, at that time, the period that the standard curve reaches the limit delay rate L, or namely the duration period, is denoted as Te0, though the duration period Te1 from the preliminary estimation curve can be calculated according to the magnification difference b, the estimation operation may not be performed yet because the accuracy is not good at that time (as a matter of course, the estimation can be done).

$$Te1=b\times Te0=(T1\times Te0)/T0 \tag{8}$$

The second process in which the duration estimation operation is performed where the estimation is set again to improve the accuracy is described. First, the timing delay rate y of the feeding roller is measured again at T2 after a prescribed time passes from the first process. The delay rate y at that time is denoted as K2. When the coordinate M of the time axis of the apex among the parameters of the quadratic function determining the estimation curve is fixed to M0×b of the preliminary estimation curve, a curve, or the final estimation curve shown in FIG. 6, passing two points (T1, K1), (T2, K2), whose apex is on t=M0×b, is determined.

$$K1=B\times(T1-M0\times b)^2+N \tag{9}$$

$$K2=B\times(T2-M0\times b)^2+N \tag{10}$$

That is, where B, N obtained as solutions of the simultaneous equation (Formula 9, Formula 10), are denoted as B2, N2, respectively for the purpose of simplicity, the function of the final estimation curve shown in FIG. 6 is as shown in Formula (11).

$$y=B2\times(t-M0\times b)^2+N2 \tag{11}$$

Based on this function expressing the final estimation curve, the controller 40 performs the duration estimation operation to calculate with following Formula 12 (quadratic function) the period Te at which the delay rate y of the conveyance timing reaches the limit delay rate L.

$$Te=\sqrt{((L-N2)/B2)}+M0\times b \tag{12}$$

According to the steps of the duration estimation for this roller, first, based on a known standard curve, a preliminary estimation curve is determined as a basis, and second, to improve the accuracy, a final estimation curve is produced in modifying the preliminary estimation curve as matching to the actual phenomenon. When the duration estimation operation is executed according to the function, the controller 40 automatically transmits the operation result to a service center through a network line. With this transmission, servicemen at the service center can understand by when they should come to replace the roller or rollers.

It is to be noted that although in this embodiment the estimation of the duration is not made again after the final estimation curve is determined, such modification of the estimation curve and estimation of the duration can be done again in a number of times before reaching the end of the duration.

As described above, according to this embodiment, this method is effective for the roller having property that worn slightly at the initial stage but acceralatingly as closer to the end of the duration, and the duration period of the roller that may vary according to circumstances of the installation of the printer body, kinds and use frequency of the sheets used by the users, and the like can be estimated with flexibility and great accuracy. Consequently, troubles such as jamming due to delay can be surely prevented from occurring.

Because the service station side can monitor with good accuracy the replacement timing of the rollers installed in the user's apparatus by transmission of the duration period information to the service station or center through the network, the service station side can optimize as to which roller replacement has a priority. Consequently, no jamming occurs due to delay of replacements, and therefore the quality of the service can be promoted significantly while the efficiency of the services can be improved greatly.

Moreover, running costs can be advantageously reduced not because the rollers having plenty time before the duration period are replaced in an early timing but because rollers can be replaced after used adequately.

Other Embodiments

Although in the above embodiments the delay rate with respect to the set value of the arrival timing of the sheet to the sheet detecting sensor 33 is used as a means for detecting the wearing degree of the roller, this invention is not limited to the above. For example, the outer diameter size of the roller can be measured with a sensor; the actual conveyance rate of the sheet can be monitored with a drive roller; various means are applicable when detecting lowered conveyance rate.

Although in the above embodiments the duration estimation operation is executed at a time when the delay rate of the sheet conveyance timing exceeds the threshold value, this invention is not limited to this method. For example, such operation can be executed periodically, or a sequence in which operation is executed frequently after exceeding the threshold value, can be used. An execution signal may be applied from the outside such as the service station side to execute the duration estimation operation.

Although in the above embodiments the passed time after the last replacement of the roller is used as it is for the duration estimation, for example, the period can exempt a period that power is turned off for a long time. Estimation can be made with higher accuracy in use of time information as well as passing paper counter information (for example, the operation formula is changed between a case that greatly worn even where the passed sheet number is small and a case that not so much worn, or the operation formula is changed in detecting abrupt changes of the use frequency, etc.).

Although in the above embodiments, exemplified is that the duration period information is transmitted to the information terminal (such as service station or the like) located at the exterior of the image forming apparatus through the network when the duration period of the roller is estimated, this invention is not limited to the above. For example, though not shown, the information can be displayed at a display means of the controlling section of the image forming apparatus or can be outputted by recording the information on the sheet.

In the above embodiments, exemplified is a case that this invention applies to the duration period estimation of the roller as a rotary member at the sheet feeding section, but this invention is not limited to this. Substantially the same results can be obtained in use of the invention to estimate the duration period of other rollers as rotary bodies for conveying sheets.

In the above embodiments, exemplified as a rotary member for conveying sheets is a roller made of rubber material, but this invention is not limited to the roller including material, shape, etc. For example, this invention is applicable to a belt form such as the sheet conveyance section 21 shown in FIG. 1, and substantially the same results can be obtained.

Although in the above embodiments, the printer is exemplified as an image forming apparatus, this invention is not limited to this apparatus. For example, other image forming apparatuses such as photocopiers, facsimile machines, and hybrid machines having a plurality of those functions, can be used. This invention is applicable to the duration estimation of the rotary member used in the sheet conveyance in those image forming apparatuses, and substantially the same results can be obtained.

With the above embodiments, exemplified are the rotary bodies in association with the sheet conveyance such as recording paper or the like as a recording target, but this invention is not limited to this. For example, substantially the same advantage can be obtained where this invention applies to a rotary member in association with sheet conveyance of original documents to be read.

In the above embodiments, the electrophotographic method is exemplified as the recording method, but this invention is not limited to this method, and for example, other recording methods such as inkjet methods or the like can be used.

What is claimed is:

1. A sheet conveyance apparatus comprising:

a rotary member for conveying a sheet;

wearing degree detecting means for detecting lowered conveyance performance due to wear of the rotary member;

time managing means for measuring operation time of the rotary member;

limit wearing degree memorizing means for memorizing in advance a limit wearing degree immediately before the rotary member becomes unable to make conveyance due to wear; and duration estimating means for estimating a time at which the rotary member becomes unable to make conveyance due to wear;

wherein the duration estimating means uses the wearing degree of the rotary member detected by the wearing degree detecting means, the operation time of the rotary member measured by the time managing means, and the limit wearing degree memorized by the limit wearing degree memorizing means, to calculate according to an estimation function the time ending the duration at which the rotary member becomes unable to make conveyance due to wear.

2. The sheet conveyance apparatus according to claim 1, wherein the duration estimating means has a duration operating algorithm approximating, with a linear function, transition of the wearing degree of the rotary member as the lapse of time serving as the estimation function, and calculates according to the duration operating algorithm the duration period at which the rotary member becomes unable to make conveyance due to wear.

3. The sheet conveyance apparatus according to claim 2, wherein the duration operating algorithm approximated with the linear function is represented by a formula:

$$Te=T\times(L-A)/(K-A)$$

wherein the wearing degree of the rotary member during execution of the operation is denoted as K; the wearing degree of the rotary member at an initial state is denoted as A; the limit wearing degree stored in advance in the limit wearing degree memorizing means is denoted as L; the working period of the rotary member from the initial state to the present time measured by the time managing means is denoted as T; the duration period at a time when the rotary member becomes unable to make conveyance due to wear is denoted as Te.

4. The sheet conveyance apparatus according to claim 1, wherein the duration period is estimated at a time that the wearing degree of the rotary member at the present time detected by the wearing degree detecting means exceeds a standard wearing degree set in advance with a prescribed margin based on the limit wearing degree.

5. The sheet conveyance apparatus according to claim 1, wherein the duration estimating means has a duration operating algorithm approximating, with a quadratic function, transition of the wearing degree of the rotary member as the lapse of time serving as the estimation function, and calculates according to the duration operating algorithm the duration period at which the rotary member becomes unable to make conveyance due to wear.

6. The sheet conveyance apparatus according to claim 5, wherein the duration operating algorithm approximated with the quadratic function includes the steps in which:

first, an estimation curve is set as a reference in advance using a curve represented by a formula, $$y=B\times(t-M)^2+N$$

wherein a timing delay rate of the rotary member is denoted as y; the operation time is denoted as t; the coordinate of the wearing degree axis corresponding to an apex of the quadratic function is denoted as N; the coordinate of the time axis corresponding to the same apex is denoted as M; the coefficient of the gradient of the quadratic function is denoted as B;

then, a preliminary estimation curve is determined based on the estimation curve as the reference at a time that the wearing degree of the rotary member at the present time detected by the wearing degree detecting means exceeds a standard wearing degree set in advance with a prescribed margin based on the limit wearing degree;

and then, the duration period Te as a time t at which the timing delay rate y of the rotary member reaches a limit delay rate L is calculated based on a function expressing a final estimation curve with the following formula from a coordinate N2 of the apex of the actual quadratic function, a coordinate M0 on the time axis of the actual quadratic function, and a coefficient B2 of the gradient of the actual quadratic function, and a magnification difference b on the time axis compared the estimation curve with the actual quadratic function, $$Te=\sqrt{((L-N2)//B2)}+M0\times b$$

where the final estimation curve is produced by modifying the preliminary estimation curve with transition of the actual wearing degree of the rotary member after a preset time is passed.

7. The sheet conveyance apparatus according to claim 1, wherein the duration estimating means estimates the duration period of the rotary member, periodically or when requested from the exterior of the apparatus, notwithstanding of the wearing degree of the rotary member.

8. An image forming apparatus for forming an image on a sheet, comprising:

recording means for forming an image on a sheet; and the sheet conveyance apparatus as set forth in any of claims 1 to 7, as a conveying means for conveying the sheet with a rotary member to the recording means.

9. The image forming apparatus according to claim 8, wherein the duration estimating means includes an information communicating means cable of transmitting estimation information to an information terminal located at the exterior of the image forming apparatus through a network when the duration period of the rotary member is estimated.

10. The image forming apparatus according to claim 8, wherein the duration estimating means can display, on a displaying means at a controlling section, or can output, upon recording on a sheet, duration period information when the duration period of the rotary member is estimated.

11. An estimating method of a duration of a rotary member for estimating a duration period at which the rotary member for conveying a sheet is unable to make conveyance due to wear, the method comprising the steps of:

memorizing in advance in a limit wearing degree memorizing means a limit wearing degree immediately before the rotary member become unable to make conveyance due to wear;

detecting, by a wearing degree detecting means, lowered conveyance performance due to wear on the rotary member;

measuring operation time of the rotary member with a time managing means; and calculating with an estimation function a duration period at which the rotary member becomes unable to make conveyance due to wear in utilizing the wearing degree of the rotary member detected by the wearing degree detecting means, the operation time of the rotary member measured by the time managing means, and the limit wearing degree memorized at the limit wearing degree memorizing means.

12. The estimating method according to claim 11, wherein a duration estimating means includes a duration operating algorithm approximating, with a linear function, transition of the wearing degree of the rotary member as the lapse of time serving as the estimation function, and calculates according to the duration operating algorithm the duration period at which the rotary member becomes unable to make conveyance due to wear.

13. The estimating method according to claim 12, wherein the duration operating algorithm approximated with the linear function is represented by a formula:

$$Te=T\times(L-A)/(K-A)$$

wherein the wearing degree of the rotary member during execution of the operation is denoted as K; the wearing degree of the rotary member at an initial state is denoted as A; the limit wearing degree stored in advance in the limit wearing degree memorizing means is denoted as L; the working period of the rotary member from the initial state to the present time measured by the time managing means is denoted as T; the duration period at a time when the rotary member becomes unable to make conveyance due to wear is denoted as Te.

14. The estimating method according to claim 11, wherein a duration estimating means has a duration operating algorithm approximating, with a quadratic function, transition of the wearing degree of the rotary member as the lapse of time serving as the estimation function, and calculates according to the duration operating algorithm the duration period at which the rotary member becomes unable to make conveyance due to wear.

15. The estimating method according to claim 11, wherein the duration operating algorithm approximated with the quadratic function includes the steps in which:

first, an estimation curve is set as a reference in advance using a curve represented by a formula, $$y=B\times(t-M)^2+N$$

wherein a timing delay rate of the rotary member is denoted as y; the operation time is denoted as t; the coordinate of the wearing degree axis corresponding to an apex of the quadratic function is denoted as N; the coordinate of the time axis corresponding to the same apex is denoted as M; the coefficient of the gradient of the quadratic function is denoted as B;

then, a final estimation curve is sought which is expressed as:

$$y=B2\times(t-M0\times b)^2+N2$$

upon determining a coordinate N2 of the apex of the actual quadratic function, a coordinate M0 on the time axis of the actual quadratic function, and a coefficient B2 of the gradient of the actual quadratic function, and a magnification difference b on the time axis compared the estimation curve with the actual quadratic function, at a time that the wearing degree of the rotary member at the present time detected by the wearing degree detecting means exceeds a standard wearing degree set in advance with a prescribed margin based on the limit wearing degree;

and then, the duration period Te as a time t at which the timing delay rate y of the rotary member reaches a limit delay rate L is calculated using the final estimation curve with the following formula:

$$Te=\sqrt{((L-N2)/B2)}+M0\times b.$$

* * * * *

UNITED STATES PATENT AND TRADEMARK OFFICE

CERTIFICATE OF CORRECTION

PATENT NO. : 6,988,727 B2
APPLICATION NO. : 10/383629
DATED : January 24, 2006
INVENTOR(S) : Takashi Yano It is certified that error appears in the above-identified patent and that said Letters Patent is hereby corrected as shown below:

Drawings,
Sheet 2 of 7, Figure 2, “trictional” should read -- frictional --.

Column 1,
Line 34, “care” should read -- care for --.
Line 59, “a” should be deleted.

Column 2,
Line 9, “loose” should read -- lose --.
Line 39, “an” should read -- a --.

Column 4,
Line 17, “conveyance” should read -- convey --.

Column 5,
Line 53, “valve,” should read -- value, --.

Column 6,
Line 9, “plenty” should read -- plenty of --.
Line 11, “used” should read -- being used --.

Column 9,
Line 2, “plenty” should read -- plenty of --.
Line 4, “used” should read -- being used --.

UNITED STATES PATENT AND TRADEMARK OFFICE

CERTIFICATE OF CORRECTION

PATENT NO. : 6,988,727 B2
APPLICATION NO. : 10/383629
DATED : January 24, 2006
INVENTOR(S) : Takashi Yano It is certified that error appears in the above-identified patent and that said Letters Patent is hereby corrected as shown below:

Column 12,
Line 10, “become” should read -- becomes --.

Signed and Sealed this

Eleventh Day of July, 2006

JON W. DUDAS
*Director of the United States Patent and Trademark Office*